US005718256A

United States Patent [19]

Buezis et al.

[11] Patent Number: 5,718,256

[45] Date of Patent: Feb. 17, 1998

[54] BURNER CONTROLLER ASSEMBLY

[75] Inventors: James G. Buezis, Plymouth, Minn.; Paul Dietiker, Redondo Beach, Calif.

[73] Assignee: Honeywell Inc., Minneapolis, Minn.

[21] Appl. No.: 645,987

[22] Filed: May 14, 1996

[51] Int. Cl.[6] ..... F16K 31/06; F23N 5/10; F23D 14/72

[52] U.S. Cl. ..... 137/66

[58] Field of Search ..... 137/65, 66; 431/51, 431/52, 54, 56, 81

[56] References Cited

U.S. PATENT DOCUMENTS

| | | | |
|---|---|---|---|
| 1,885,724 | 11/1932 | Horton | 431/52 |
| 2,596,796 | 5/1952 | Solovieff | 137/66 |
| 2,695,056 | 11/1954 | Caparone et al. | 137/66 |
| 2,871,930 | 2/1959 | Drow | 431/56 |
| 2,917,062 | 12/1959 | Schuchardt | 137/66 |
| 2,969,077 | 1/1961 | Vicenzi | 137/66 |
| 2,988,098 | 6/1961 | Thomas | 137/66 |
| 3,084,900 | 4/1963 | Baak | 251/54 |
| 3,259,811 | 7/1966 | Dunn | 335/270 |
| 3,264,421 | 8/1966 | McIntosh et al. | 200/61.86 |
| 3,451,407 | 6/1969 | Fairley et al. | 137/66 |
| 3,581,765 | 6/1971 | Stefani | 137/553 |
| 3,877,475 | 4/1975 | Dietiker | 137/66 |
| 3,933,419 | 1/1976 | Romanelli | 431/66 |
| 3,973,576 | 8/1976 | Dietiker | 137/66 |
| 4,183,000 | 1/1980 | Storez | 137/66 |
| 4,560,968 | 12/1985 | Gagnon | 251/129.1 |
| 4,729,396 | 3/1988 | Kelly et al. | 137/66 |

FOREIGN PATENT DOCUMENTS

| | | | |
|---|---|---|---|
| 0502558 | 9/1992 | European Pat. Off. . | |
| 1529053 | 10/1969 | Germany | 137/66 |
| 347518 | 4/1931 | United Kingdom | 431/81 |
| 452304 | 8/1936 | United Kingdom | 431/56 |

*Primary Examiner*—George L. Walton
*Attorney, Agent, or Firm*—Edward L. Schwarz

[57] ABSTRACT

A burner controller for safe operation of a furnace has a an electromechanical latch for holding first and second fuel valves open responsive to an enable signal. The latch comprises an armature attached to the second valve and an electromagnet assembly attached to the first valve. When the electromagnet assembly receives the enable signal and the armature is attracted to the electromagnet assembly, the magnetic force opposes force of a spring urging the first and second valve simultaneously closed. When the enable signal is not present, the spring forces both valves into their closed position. An auxiliary valve in series flow arrangement with the second valve opposes flow of fuel passing through the second valve in certain situations.

14 Claims, 7 Drawing Sheets

10
80
89
83
93
86
91
51
75
74
69
43
44
42
36
31
33
32
41
35
45
30
46
90
86
92
67
73
70
55
49
48
47
61
62
40
65
38
39
37
45
46
15
11
27
24
23
20
19
21
18
54
34
13

80
89
83
93
86
90
86
92
67
73
70
94
88
91
51
55
75
49
54
74
48
69
47
43
61
44
62
42
36
40
31
65
33
38
34
32
39
37
41
45
35
46
45
30
13
46
15
11
19
18
27
24
23
20
21

80
89
83
93
90
86
86
92
87
94
67
73
51
70
88
91
75
57
54
74
47
60
58
69
61
48
43
44
62
42
49
40
36
31
65
33
38
34
32
39
37
35
45
41
46
45
30
15
13
46
11
19
27
18
24
21
23
20

80
89
83
93
86
90
92
67
73
70
86
87
91
94
88
51
75
69
48
74
43
44
42
36
31
33
57
49
60
58
47
61
62
40
65
38
39
37
45
46
15
11
54
34
32
41
35
45
46
30
13
19
18
27
24
23
20
21

BURNER CONTROLLER ASSEMBLY

BACKGROUND OF THE INVENTION

The following description pertains to a burner controller for fuel burner systems such as those used to provide heat for residences. For safe and efficient operation, a burner system must have a suitable control system. The most visible part of this control system is the thermostat, but the burner controller is arguably the most important. When heat is required at the thermostat's location the thermostat switches low voltage control power usually provided by a transformer to the other components of the control system. The control power activates the various elements of the control system to allow burner system operation.

In order to explain the operation of a burner controller, it is first necessary to understand the structure and operation of a fuel burner system generally. The combustion of the fuel occurs in the furnace's combustion chamber. Air is drawn into the combustion chamber through a fresh air duct and mixed with incoming fuel to sustain combustion. The combustion products then exit through an exhaust duct. An electrically operated main fuel valve opens in response to control power from the thermostat to allow fuel, usually natural gas or propane, to flow to a main burner element in the combustion chamber of the furnace. The combustion occurs around the main burner element where the fuel exits mixes with the air from the fresh air duct. Air or water flows around the combustion chamber, and is heated by the combustion. A pump or fan is usually provided to direct the heated water or air to the areas to be heated. When the area in which the thermostat is located has received sufficient heat, the thermostat disconnects the control system from the control power and combustion ceases.

Experience has shown that in addition to the main fuel valve which controls fuel flow to the combustion chamber on a demand basis, the presence of the previously mentioned burner controller device is needed to provide for safety in controlling fuel flow to the combustion chamber. The burner controller in a control system will typically also have other functions to be explained below. Because safety is the most important characteristic of a burner controller, they operate without any control power, at least in shutting off fuel flow in the case of lost flame. The burner controller of this invention has a structure and function yielding particular advantages for certain types of fuel burner systems.

Each time the thermostat applies power to the rest of the control system it is necessary to provide some means for igniting the fuel that flows to the burner element when the main fuel valve opens. Although a number of different igniter types have been devised over the years, perhaps the most common is the pilot flame igniter. The burner controller invention will be described as operating with a fuel burner using a pilot flame to ignite the main flame. In a pilot ignition system, a small amount of fuel is provided through a pilot fuel valve to a pilot burner element physically close to the main burner element. During a preliminary startup process, a pilot valve controlling flow of fuel to the pilot burner is opened and this fuel is lit manually or under manual control (standing pilot system) or by an igniter of some type (intermittent pilot). In an intermittent pilot system, the igniter for the pilot flame and the pilot fuel valve is electrically operated by the control system. In such a system, the pilot flame is extinguished between main flame ignition events. In a standing pilot system, the pilot valve is opened manually and the flame is lit manually. The pilot flame continues to burn until the pilot valve is manually closed. In either system, when the thermostat is satisfied, it removes the power applied to the burner controller. The main valve is designed to close when power is not provided to the control system and the main flame is extinguished. In the standing pilot system, the pilot flame continues to burn after the main flame is extinguished, remaining ready to reignite the main burner flame when the thermostat again applies power to the burner controller. The invention described is for use with a standing pilot system, but can be easily modified for use in an intermittent pilot system. Certain features of this invention may also be adapted for systems having other types of igniters.

The following description is of a burner controller for a fuel burner system using gaseous fuel such as natural gas or propane. It is possible that certain of the inventive features may be usable by systems using other types of fuels as well and perhaps may even have application for other types of systems where one fluid source is diverted into two streams or two streams of fluid are combined into one mixed stream.

The burner controller's most important safety function is to assure that a flame is present while the main and pilot valves are delivering fuel to the burner. Accordingly, the burner controller includes a pilot safety valve and a main safety valve which both close if flame in the fuel burner is not detected. Flame can be lost in a fuel burner during a time while the pilot and/or main safety valves are open for a number of reasons. For example in a standing pilot system, a dirty pilot element or a momentary drop in fuel pressure may cause the pilot flame to go out. In an intermittent pilot system, the igniter may fail to ignite the pilot flame. Main burner flame may be lost during a momentary drop in fuel pressure. If the pilot flame is not present or the main flame is absent while gas flows to the main burner, it is important that the main safety valve be promptly closed because absence of flame creates the opportunity for a relatively rapid flow into the combustion chamber of fuel which will remain unburned, which is a well known danger. Since the pilot flame operates with a relatively small fuel flow rate, it is not felt to be necessary from a safety standpoint to close off the pilot fuel should the pilot flame be lost. But the odor may be detectable, so it is preferred to shut off the pilot fuel flow as well. To assure safe operation at all times, a flame sensor is used to detect presence of the pilot and main flames whenever a fuel valve is open. If flame is not detected, the burner controller shuts its main and pilot safety valves.

A number of different types of flame sensors for burners have been developed over the years. The smaller burners used to heat residences invariably use sensors which rely on presence of the heat produced by the pilot or main flame to maintain the pilot and main safety valves open. The most common type of sensor now in use is based on the principle of thermocouple current generation. A thermocouple junction is mounted in the pilot flame, and the heat therefrom generates current comprising an enable signal. The enable signal enables an electromagnet to provide magnetic force which holds the safety valves open. If for any reason flame is lost, the hot junction cools within a minute or so two to a point where the level of the enable signal is insufficient to hold the safety valves open, and both close, ending flow of fuel to the burners.

Should pilot flame in a standing pilot system be lost for any reason, the burner controller incorporates in its design a procedure for safely relighting the pilot flame. A manual control element which controls both the main and pilot safety valves is moved to a closed position where both valves are closed. The manual control element is then moved against spring force to a pilot ignition position where the pilot safety valve is held open manually to allow fuel to flow to the pilot burner. While the pilot safety valve is held open manually, thermocouple control of the pilot valve is temporarily defeated. The pilot burner is then lit manually, with the operator continuing to hold the manual control element in its pilot ignition position. If all goes well, after a few tens of seconds, the pilot flame heats the thermocouple sufficiently to provide the enable signal which holds the safety valves open. At this point, the manual control element can be moved to a normal position where both pilot and main safety valves continue to be held open by the enable signal. In this state, the burner controller allows normal operation of the burner system with the thermostat controlling flow of control voltage to the main fuel.

Experience shows that the small amount of fuel flowing through the safety valves during the transitional stage after the main flame goes out unexpectedly and before the thermocouple has cooled sufficiently for the safety valves to close, is usually harmless. Nevertheless, certain safety bodies concerned with setting standards for gas burners consider it advisable to delay relighting the pilot flame until after the main safety valve has closed. One approach is to simply install some type of time delay inherent in the burner controller after the manual control element has been moved to its pilot ignition position. This has the potential to annoy or confuse an operator who is trying to light the pilot burner before the pilot valve has timed out.

A further consideration not unique to burner controllers is economy of design. One factor in this consideration is parts count. There is a cost associated with each part of any device. The part must be manufactured, inspected, and installed. Each step of this process adds to the cost of the final product. One aspect of reliability for any device is the number of parts, particularly, those which form part of the operating mechanism. Other things being equal, and frequently of course they are not, fewer parts means greater reliability. Where a safety critical device like a burner controller is involved, every additional part has the potential for failure or defect with safety implications, and therefore parts count is always an issue to some extent. Accordingly, design which eliminates even one part which if it fails may cause an unsafe condition to result may provide a useful increment in safety for the device.

BRIEF DESCRIPTION OF THE INVENTION

We have invented a burner controller design which satisfactorily addresses a number of these concerns for a device for controlling flow of a fluid such as a gaseous fuel from an inlet port of a housing to first and second outlet ports of the housing according to the state of an electrical enable signal. In our invention, this device has within its housing, a main chamber having i) the inlet port in flow communication with the chamber, ii) a first outlet opening in the main chamber in flow communication with said first outlet port, iii) a first valve seat encircling the first outlet opening, iv) a second outlet opening in flow communication with said second outlet port, and v) a second valve seat encircling said second outlet opening.

A first valve body includes a first seal for mating with the first valve seat. The first valve body is movable along a first valve path between an open position with the first seal spaced from the first valve seat and which allows fluid flow between the main chamber and the first outlet port, and a closed position in which the first seal mates with the first valve seat to block fluid flow between the main chamber and the first outlet port;

A second valve body includes a second seal for mating with the second valve seat. The said second valve body is movable along a second valve path between an open position with the second seal spaced from the second valve seat and which allows fluid flow between the main chamber and the second outlet port, and a closed position in which the second seal mates with the second valve seat to block fluid flow between the main chamber and the second outlet port. The first and second valve bodies having a reduced spacing relationship with respect to each other in which each of the valve bodies can be spaced from its respective valve seat.

A first compression spring is located between the first and second valve bodies. The first compression spring provides restoring force simultaneously urging each valve body into its closed position with a preselected first spring extension force range.

Finally, there is an electromechanical latch assembly in mechanical connection with the first and second valve bodies. The latch assembly receives the enable signal and responsive thereto provides a valve holding force larger than and in opposition to the preselected first spring extension force to the first and second valve bodies. The latch assembly holds the first and second valve bodies in the reduced spacing relationship.

BRIEF DESCRIPTION OF THE DRAWINGS

The following figures are all longitudinal section views of a burner controller incorporating various features of this invention. Each figure shows the burner controller in a particular functional configuration or mechanical state dependent on the effect of previous external events.

DESCRIPTION OF THE PREFERRED EMBODIMENT

The burner controller 10 shown in these Figs. is a relatively complex mechanical device with a number of individual elements which cooperate in order to provide the various functions present. Burner controller 10 has in fact, seven different mechanical states or functional configurations, each of which are dependent on external events. There are two different external events which can influence the various states of burner controller 10. One is the presence of the flame whose safety this burner controller assures. The flame determines whether a flame sensor not shown provides an enable signal to burner controller 10. The second external event is the manual control of the burner controller 10 by a human operator. There are four different mechanical states which the human operator can impose on burner controller 10.

Figure 1:
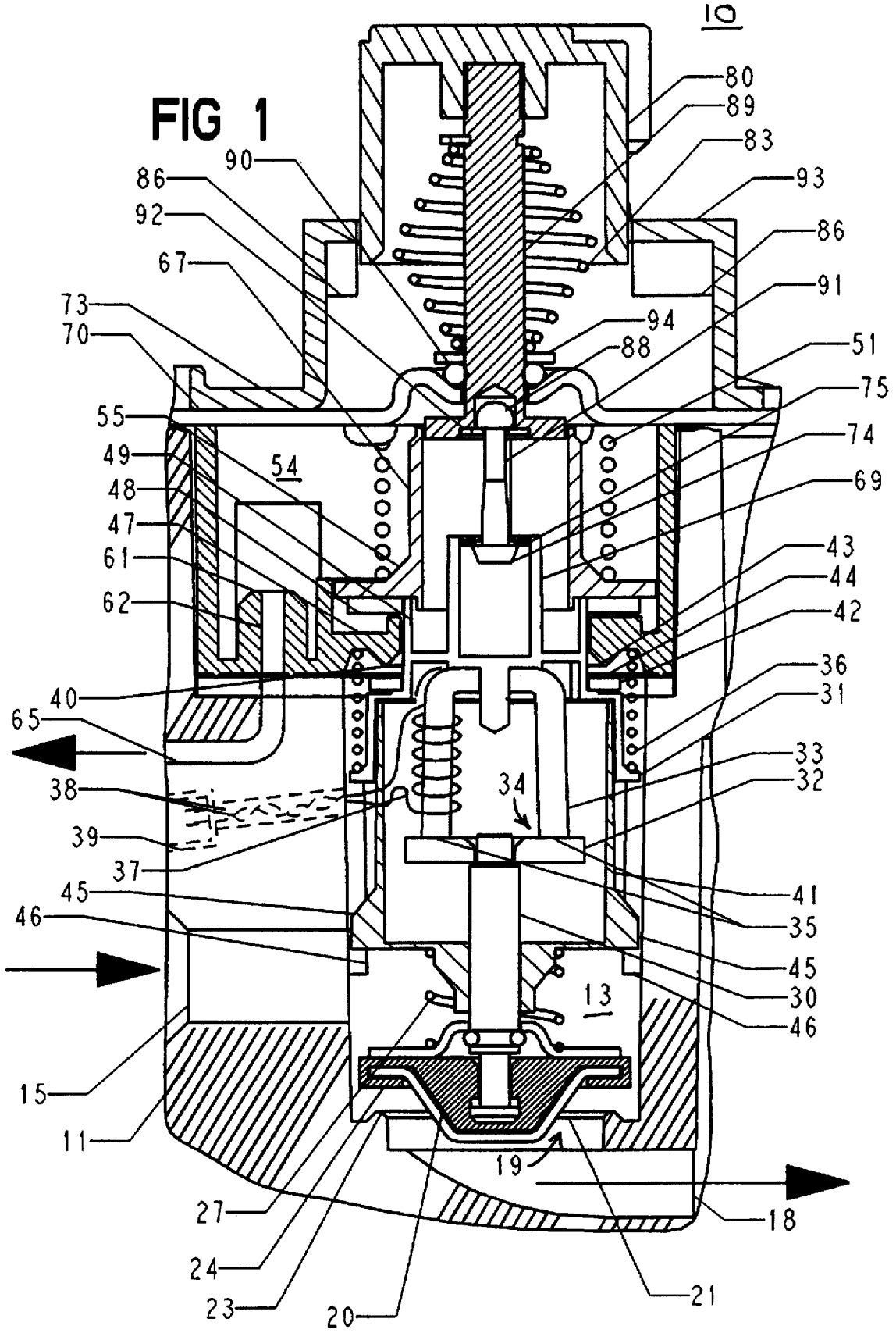
FIG. 1 shows the functional configuration of the various elements of the burner controller during normal burner system operation.

We feel that it is easiest to describe the key features of the structure and function of the burner controller when in its normal functional configuration as shown in FIG. 1, where fuel is constantly flowing to the pilot burner and is available to the main burner whenever the main control valve is opened, and the flame sensor is providing an enable signal. In the course of describing FIG. 1, it will be convenient to refer to FIG. 2 on occasion. One definition to be kept in mind during the following description is that for "flow communication", by which we mean that fluid can flow between the two spaces specified as being in flow communication with little or no pressure drop.

Turning to FIG. 1 the burner controller 10 is shown in its normal functional configuration where fuel is allowed to flow to a pilot burner and a thermostatically controlled main fuel valve (neither being shown in FIG. 1). In this configuration, pressurized gaseous fuel is introduced through an inlet port 15 into a main chamber 13. In the configuration shown in FIG. 1, this fuel can flow to a first or main outlet port 18 and a second or pilot outlet port 65. This flow of fuel presupposes presence of an enable signal which maintains the normal functional configuration for a burner controller 10 as shown in FIG. 1. The enable signal is in turn dependent on presence of at least a pilot flame.

Safety-based control of fuel flow to the main outlet port 18 depends on the operation of a main safety valve 19 comprising a first or main valve body 20 having a first or main seal 24. When main valve body 20 is in the open position shown in FIG. 1, main safety valve 19 allows fuel to freely flow from inlet port 15 to main outlet port 18. When main valve body 20 is in a closed position (shown in FIG. 2), main seal 24 mates with a first or main valve seat 23 encircling the main outlet opening 21. When so mated in the closed position, the cooperation of main valve body 20 and its seal 24 with main valve seat 23 prevents fuel flow from main chamber 13 to the main outlet port 18. Main seal 24 will preferably comprise any suitable resilient material such as rubber and commonly used for fluid seals. Main valve body 20 can move along a first or main valve path between the open position shown in FIG. 1 and the closed position of FIG. 2 where the seal 24 is mated with the main valve seat 23.

Safety-based control of fuel flow from inlet port 15 to the pilot outlet port 65 is principally under the control of second or main (in the sense of principal) pilot safety valve 40 comprising a second or pilot valve body 41 having a second or pilot seal 42. When pilot valve body 41 is in the open position shown in FIG. 1, main pilot safety valve 40 allows fuel to freely flow from inlet port 15 through a second or pilot outlet opening 44 in chamber 13 to an auxiliary chamber 54. Pilot seal 42 is designed to mate with a second or pilot valve seat 43 encircling pilot outlet opening 44 of main chamber 13 and when so mated, cooperates with pilot valve body 41 and its seal 42 to prevent fuel flow from main chamber 13 to pilot outlet port 65. Pilot valve body 41 can move along a second or pilot valve path between the open position shown in FIG. 1, and the closed position shown for pilot valve body 41 in FIG. 2 where the seal 42 is mated with the pilot valve seat 43. Projections 45 fit into axially extending slots 46 in the cylindrical wall of main chamber 13 to prevent rotation of valve body 41.

The condition created when both valve bodies 20 and 41 are positioned relative to each other to allow both valves 19 and 40 to be open will be referred to on occasion hereafter as the reduced spacing relationship. It is possible that one or the other of the two valves 19 and 40 may be closed when they are in their reduced spacing relationship relative to each other, but it is not possible for both to be closed when this relationship exists. We also wish to note that the "reduced spacing" relationship need not necessarily mean that valve bodies 20 and 41 are physically closer to each other. It is possible that another configuration of the main valve 19 and the pilot valve 40 might for example place them side by side with the valve bodies connected by a linkage of some kind rather than coaxial as shown. In a case such as that, the "reduced spacing" relationship might in fact imply that the valve bodies 20 and 41 are physically farther from each other than when in other than in the reduced spacing relationship.

We also wish to note that the seals 24 and 42 shown as forming a part of the valve bodies 20 and 41 may also be interchanged with their associated valve seats 23 and 43. That is, the valve body involved may carry the rigid seat, and the resilient seal may be placed around the periphery of the opening 21 or 44. In most cases it is more cost effective to place the seal on the valve body itself rather than on the opening.

Figure 2:
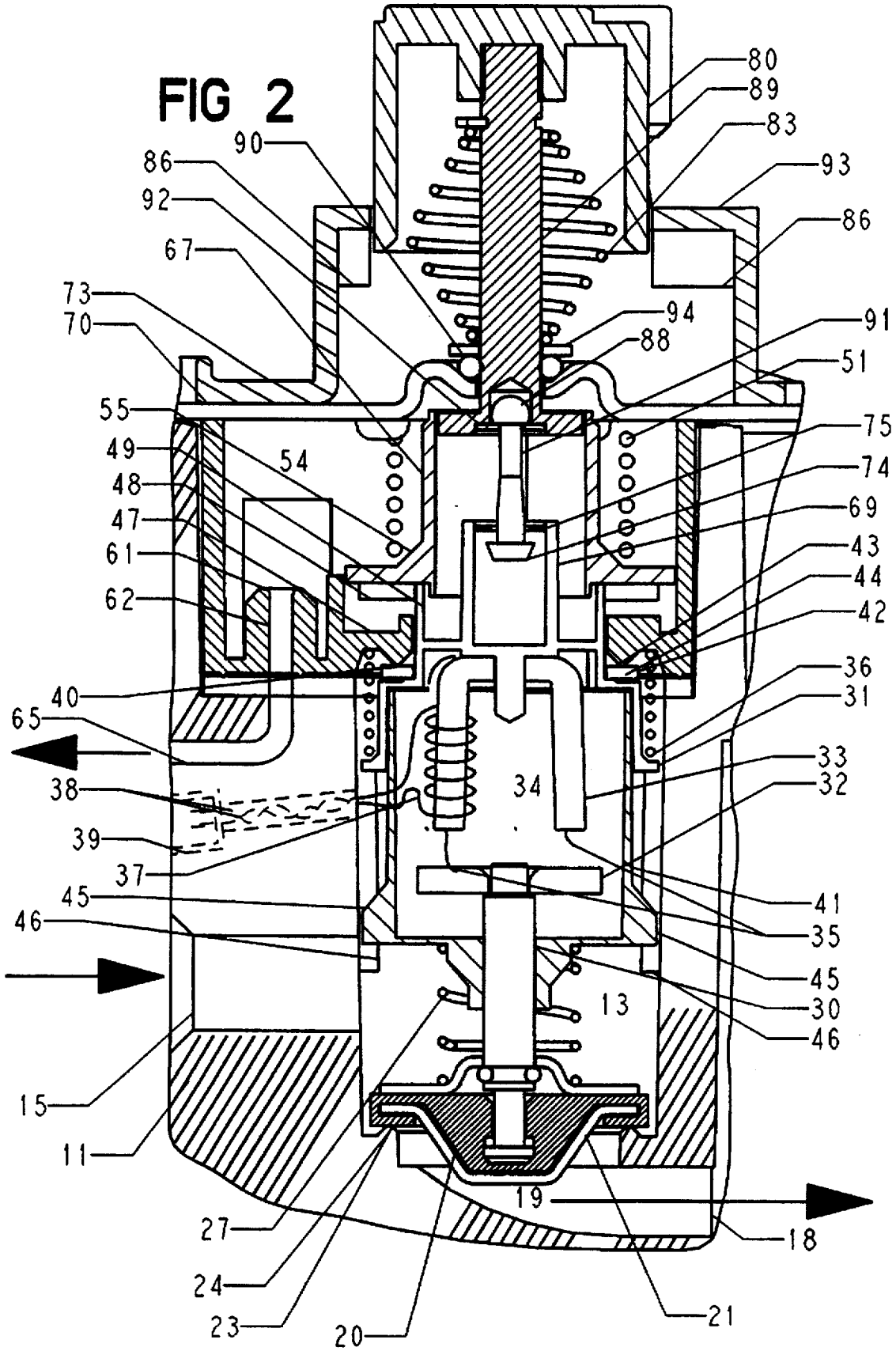
FIG. 2 shows the functional configuration of the various elements of the burner controller after the enable signal is lost during normal burner system operation.

The closed position for both main and main pilot safety valves shown in FIG. 2 is maintained by a compression spring 27 between pilot and main valve bodies 20 and 41. Spring 27 has a restoring or extension force sufficient to hold both valve bodies 20 and 41 in their closed positions.

The operation of spring 27 in holding valve bodies 20 and 41 in their closed positions is for normal operation, overridden by the operation of an electromechanical latch assembly shown generally at 34, while receiving an enable signal provided by an external pilot flame sensor to conductor pair 38. Pilot valve body 41 is shown as having an interior cavity in which latch assembly 34 is located. Latch assembly 34 has a U-shaped pole piece or field core 33 and a mating armature 32, each formed of a material such as soft iron or silicon steel which is magnetically conductive (i.e., has low reluctance) and which has low magnetic remanence. Core 33 has a pair of pole ends 35 at the ends of the U form and is magnetically continuous from one to the other of the pole ends 35 through the body of the U form. The pole piece 33 is mechanically attached to the interior of the pilot valve body 41 so that the pole ends face away from the pilot valve seat 43. The armature 32 is also located within the interior cavity of pilot valve body 41 and is mechanically connected to main valve body 20 by a shaft 30 which passes through an aperture in the end of valve body 41 which faces valve body 20. Thus latch assembly 34 can be seen as in mechanical connection with both the pilot and main valve bodies 20 and 41.

Latch assembly 34 includes a winding 37 which receives the enable signal carried on conductors 38 carried in a cavity or recess of housing 11. Conductors 38 are attached to a connector plug 39 which seals the end of the cavity to prevent pressurized fuel within chamber 13 from escaping. A present commercial embodiment has conductors 38 and plug 39 routed differently from that shown, but the present version is preferred as easier for the reader to understand. There should be sufficient slack in conductors 38 between the interior walls of chamber 13 and winding 37 to permit movement of valve body 41 between its closed position and its most extreme open position. Conductors 38 should also be chosen to tolerate the on-going flexing of them which occurs while pilot valve body 41 moves between its closed and open positions. The enable signal comprises a DC current provided by the flame sensor. The winding 37 with the enable signal current flowing therein creates magnetic attraction comprising a valve holding force between core 33 and armature 32 which when armature 32 is contacting both pole ends 35, is stronger than the restoring force of spring 27. Thus, when valve bodies 20 and 41 and latch assembly 34 are in the functional configuration shown in FIG. 1, and the enable signal current is flowing in winding 37, the magnetic attractive force between core 33 and armature 32 is sufficient to hold the pilot and main valve bodies in the reduced spacing relationship.

The human operator selects which of the various functional configurations of burner controller 10 are possible by rotating a control knob 80 and a shaft 89 fixedly attached to it, to one of three positions, ON, PILOT, and OFF. Knob 80 is shown in its ON position in FIGS. 1 and 2. Knob 80 is retained in a cover 73 attached to housing 11 by machine screws not shown, and with a gasket between them to prevent fuel leakage from the auxiliary chamber 54. Knob 80 when rotated to the PILOT and OFF positions, axially translates from the ON position of FIGS. 1 and 2 to other axial positions wherein knob 80 is forced further into cover 73. In the ON position of FIGS. 1 and 2, knob 80 is extended to its maximum outwardly position from cover 73 under the extension force from a knob compression spring 83 between a washer 94 and a retainer on shaft 89. Radial projections 87 on knob 80 cooperate with an inwardly projecting annular lip 93 of cover 73 to axially retain knob 80 in its ON position. Shaft 89 penetrates a cover 70 to enter chamber 54 part way. Spring 83 presses on washer 94 to compress O-ring 90 so as to form a seal against shaft 89 preventing fuel from leaking past shaft 89, and at the same time allowing shaft 89 to both shift axially and rotate.

Shaft 89 serves in the following manner as part of a valve positioner which positions the first and second valve bodies 20 and 41 as shown in FIG. 1. This state of the valve positioner elements will be called the ON position, with fuel able to flow through both openings 21 and 44. Shaft 89 has on its end opposite knob 80, a socket which retains the ball 88 of a connecting rod 91 which can swivel within a limited range. Rod 91 has on its lower end a flange 74 which mates with and is retained by a lip 75 which extends radially inward and is carried on a projection 69 which itself is integral with pilot valve body 41. Lip 75 cooperates with flange 74 to prevent pilot valve body 41 from axially shifting further from its closed position than the position shown in FIG. 1. Flange 74 and lip 75 do not in any way oppose axial movement of pilot valve body 41 from its open to its closed position.

Compression spring 36 is interposed between flange 31 on pilot valve body 41 and an internal feature of chamber 13, and provides extension force urging pilot valve body 41 further from its closed position and more fully into its open position as shown. The extension force provided by spring 83 in the functional configuration of FIGS. 1 and 2 is greater than the extension force of spring 36. Accordingly, spring 36 holds lip 75 in contact with flange 74 and pilot valve body 41 in its open position, but cannot deflect spring 83 in any manner. Thus the mechanism comprising in sequence cover 73, lip 93, projection 87, knob 80, shaft 89, flange 74, lip 75 and projection 69 all cooperate with each other and with springs 36 and 83 to comprise a valve positioner mechanism which maintains both pilot and main valve bodies 41 and 20 in their respective open positions. Thus, in the functional configuration of FIG. 1, fuel can flow freely through both openings 21 and 44 to the outlet ports 18 and 65. For this reason, this position of the valve positioner elements in FIG. 1 is called the ON position, referring to the fact that both valve bodies 20 and 41 are in their open positions.

FIG. 2 shows the functional configuration should the enable signal cease during normal burner operation. In this configuration absence of the enable signal causes the magnetic attraction force between the armature 32 and core 33 to nearly disappear so that spring 27 pushes both of the valve bodies 20 and 41 into their closed positions. The enable signal must have a level small enough to prevent its mere presence from creating sufficient flux flow in core 33 to reestablish the reduced spacing relationship for valve bodies 20 and 41 when armature 32 is spaced from pole ends 35. It is important to note that the range of extension force which spring 27 provides must exceed the extension force range of spring 36, so that spring 27 can overcome the force of spring 36 and press pilot valve body 41 into its closed position when armature 32 is separated from core 33.

Figure 3:
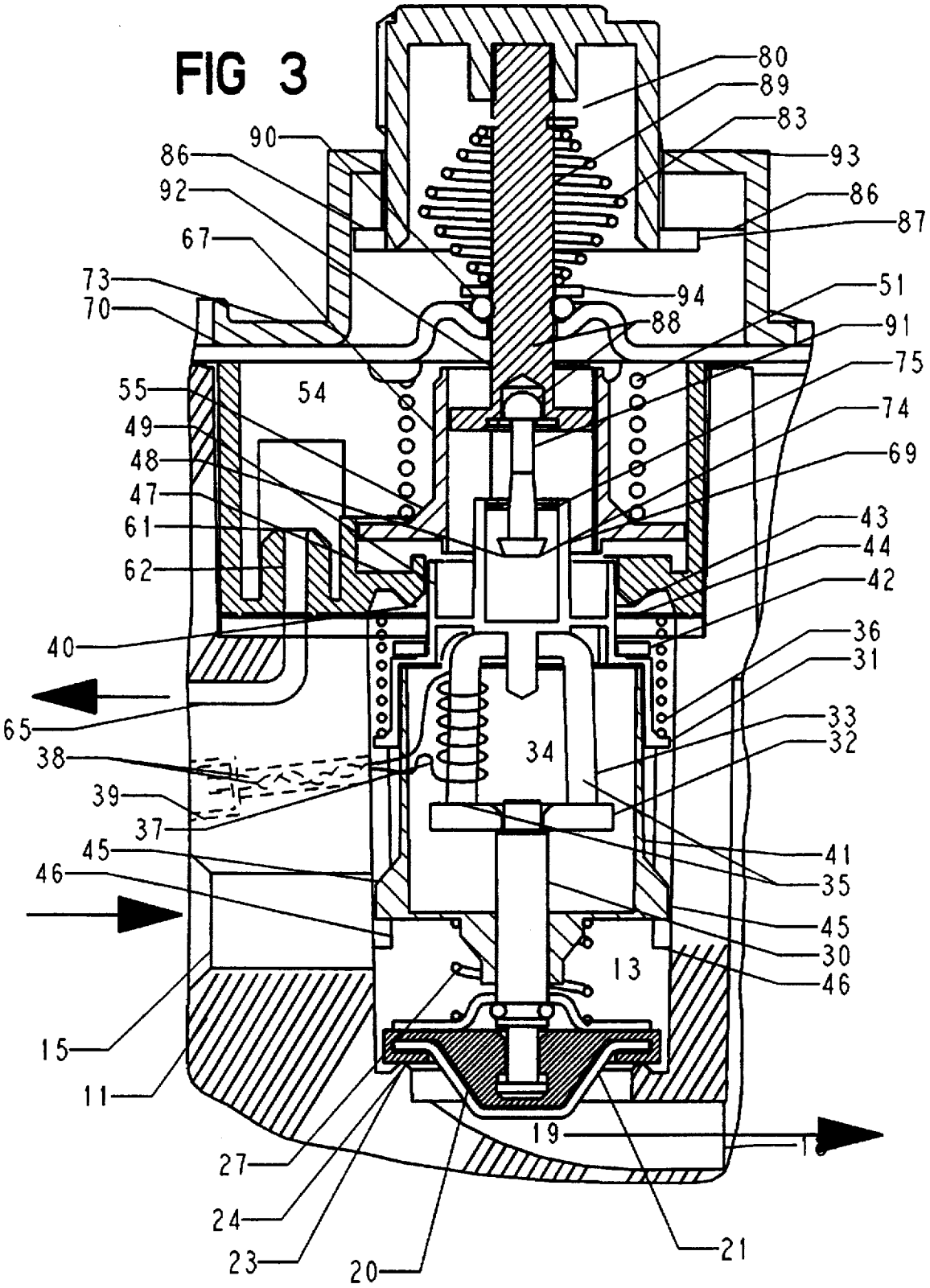
FIG. 3 shows the functional configuration of the various elements of the burner controller when supplying fuel for a normally burning pilot flame.

Burner controller 10 in its third functional configuration allows continuous flow of fuel to pilot outlet port 65 but prevents flow of fuel to main outlet port 18. This functional configuration is shown in FIG. 3, and further requires presence of the enable signal. To understand FIG. 3, it is necessary to describe further elements of burner controller 10. The human operator can rotate control knob 80 and shaft 89 to the PILOT position shown in FIGS. 3–5. The PILOT position for knob 80 can be entered from the normal ON position of FIGS. 1 and 2, and from a final stage OFF position of FIG. 7. As the operator rotates knob 80 from the ON position of FIGS. 1 and 2 into the PILOT position shown in FIGS. 3–5, projections 87 of knob 80 slide over axially facing cam surfaces 86 of lip 93 and function as a cam follower for cam surfaces 86. The camming action generates a force which axially shifts knob 80 further into cover 73 against the extension force of spring 83. The axial shift of knob 80 causes shaft 89 to also shift axially toward main valve seat 23, and spring 36 extends further so as to move lip 75 closer to main valve seat 23 and pilot valve body 41 to reach an even more open position. The profile of cams 86 is such that when knob 80 has rotated into its PILOT position, main valve body 20 reaches its closed position and lip 75 has advanced axially to a point where it loses contact with flange 74. At this point, flow of fuel to main outlet port 18 is halted and fuel continues to flow to pilot outlet port 65.

We refer to the state of the valve positioner elements shown in FIG. 3 as the pilot position, where the first or main valve 20 body is in its closed position, and the second or pilot valve body 41 is in its open position. The valve positioner elements are placed in their pilot position by the axial translation of shaft 89 when the knob 80 is turned to its PILOT position.

Figure 4:
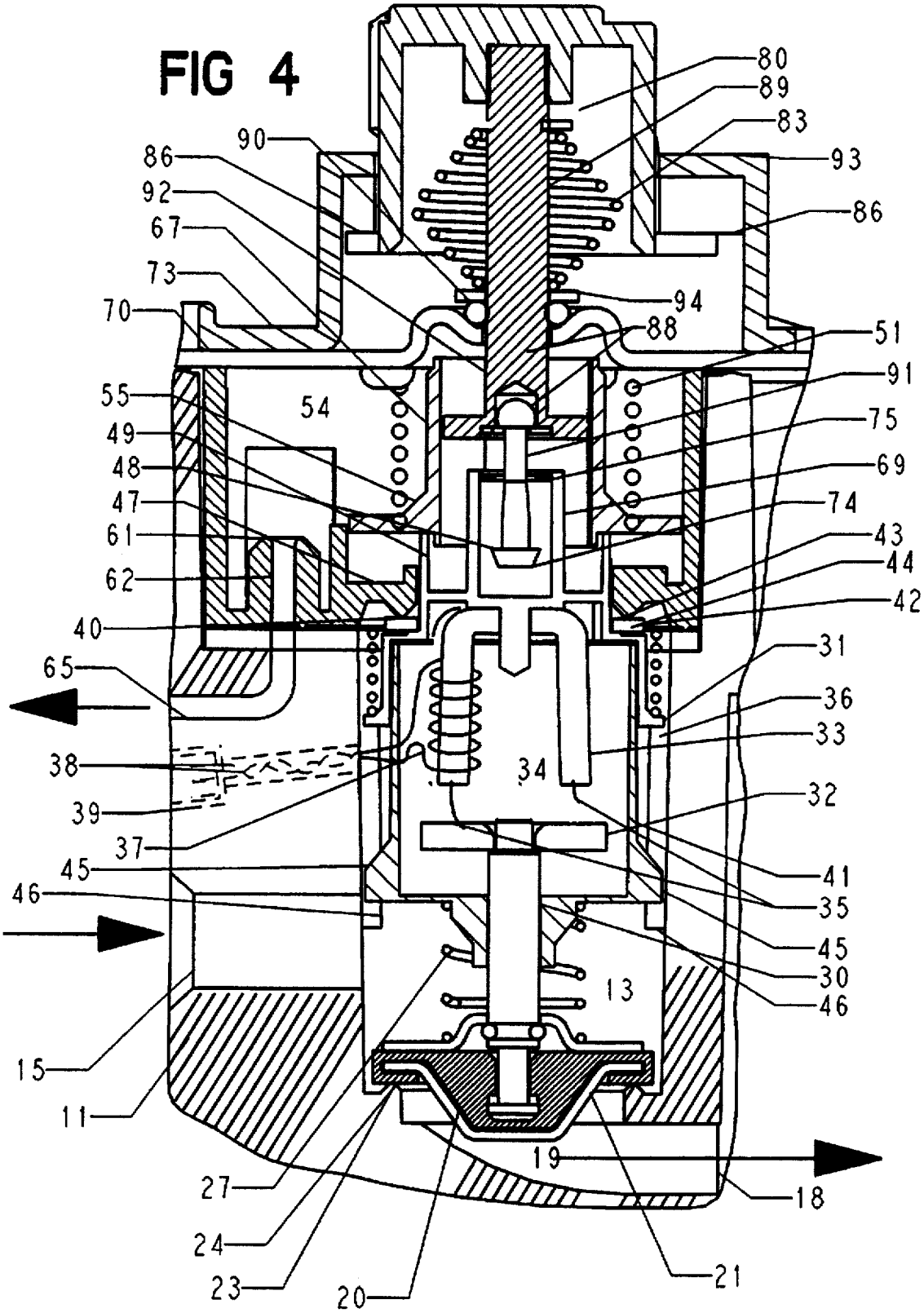
FIG. 4 shows the functional configuration of the various elements of the burner controller as for that of FIG. 3, but without presence of an enable signal.

FIG. 4 shows the mechanical arrangement when the enable signal is lost for the functional configuration of FIG. 3. In this case, armature 32 separates from pole ends 35 under the extension force of spring 27. As was previously mentioned, the extension force range of spring 27 exceeds that of spring 36, and the balance of forces provided by springs 27 and 36 causes pilot valve body to reach its closed position and halt flow of fuel to pilot outlet port 65. Again, loss of the enable signal results in shutting off fuel flow to the pilot outlet port 65.

Figure 5:
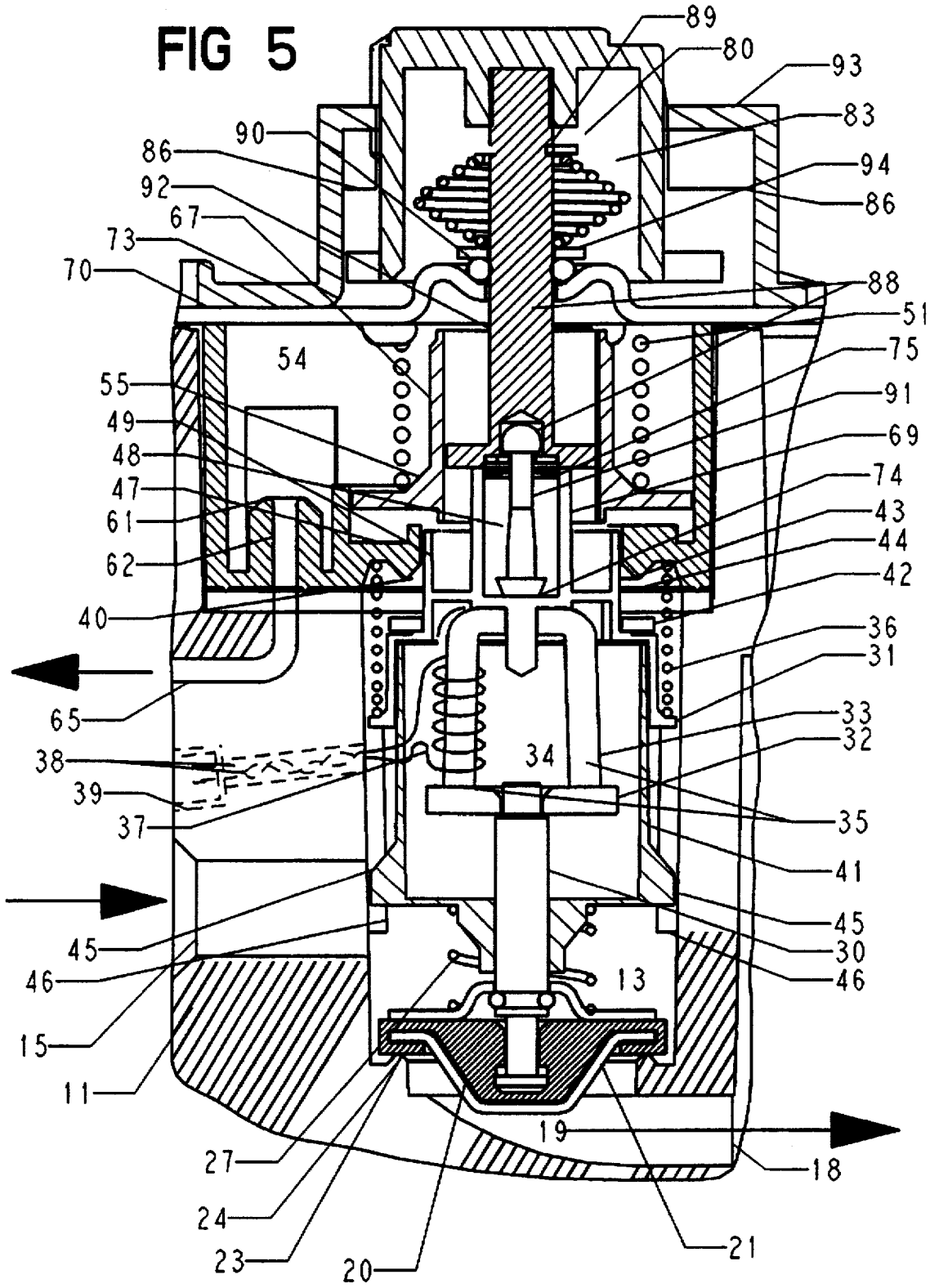
FIG. 5 shows the functional configuration of the various elements of the burner controller when positioned for manually lighting the pilot flame.

FIG. 5 shows the functional configuration during lighting of the pilot flame. The operator can further axially depress knob 80 against the extension force of spring 83 to a position where a flange 92 which is rigidly mounted on shaft 89 presses on the end of projection 69. The operator can then further depress knob 80, transmitting axial force through flange 92 to urge pilot valve body 41 into its open position against the extension force of spring 27. Fuel will again flow to pilot outlet port 65 allowing the operator to manually relight the pilot flame. At the same time, the operator's force on knob 80 holds the pole ends 35 against armature 32. When the pilot flame has been established, the flame sensor will again provide an enable signal to winding 37. With the operator's force on knob 80 holding the pole ends 35 against armature 32, the newly present enable signal will establish the magnetic attraction between core 33 and armature 32 necessary to hold valve bodies 20 and 41 in their reduced spacing configuration. When the operator releases knob 80, the knob and its shaft 89 return to the position and condition of FIG. 3. The operator can now rotate knob 80 into its ON position as shown in FIGS. 1 and 2, with cams 86 releasing followers 87 and allowing knob 80 to shift axially out of cover 73. Fuel can now flow to main outlet port 18. As soon as the main control valve opens, a main flame can again burn.

Figure 6:
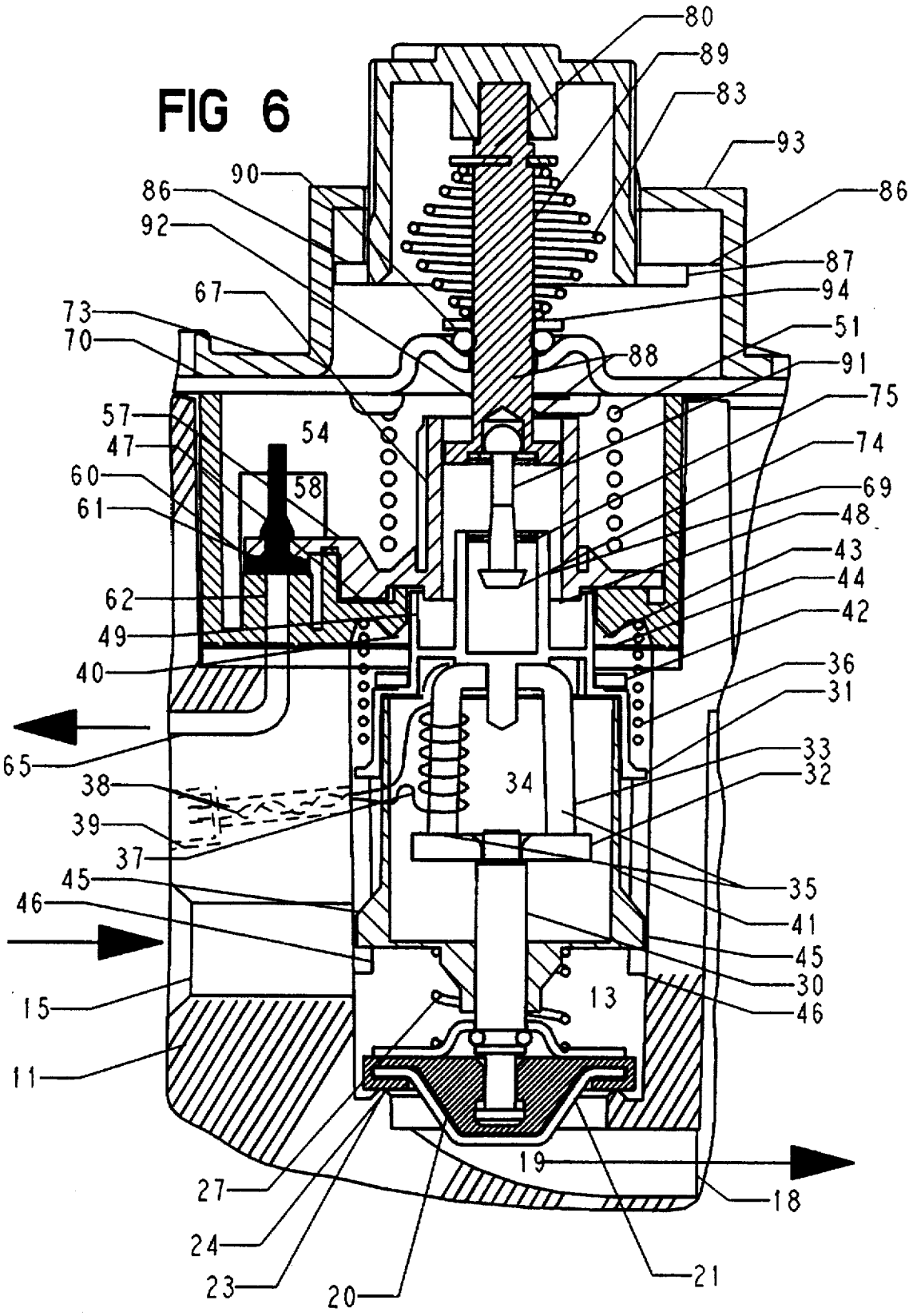
FIG. 6 shows the functional configuration of the various elements of the burner controller in a first stage off position, where the enable signal is still present.
Figure 7:
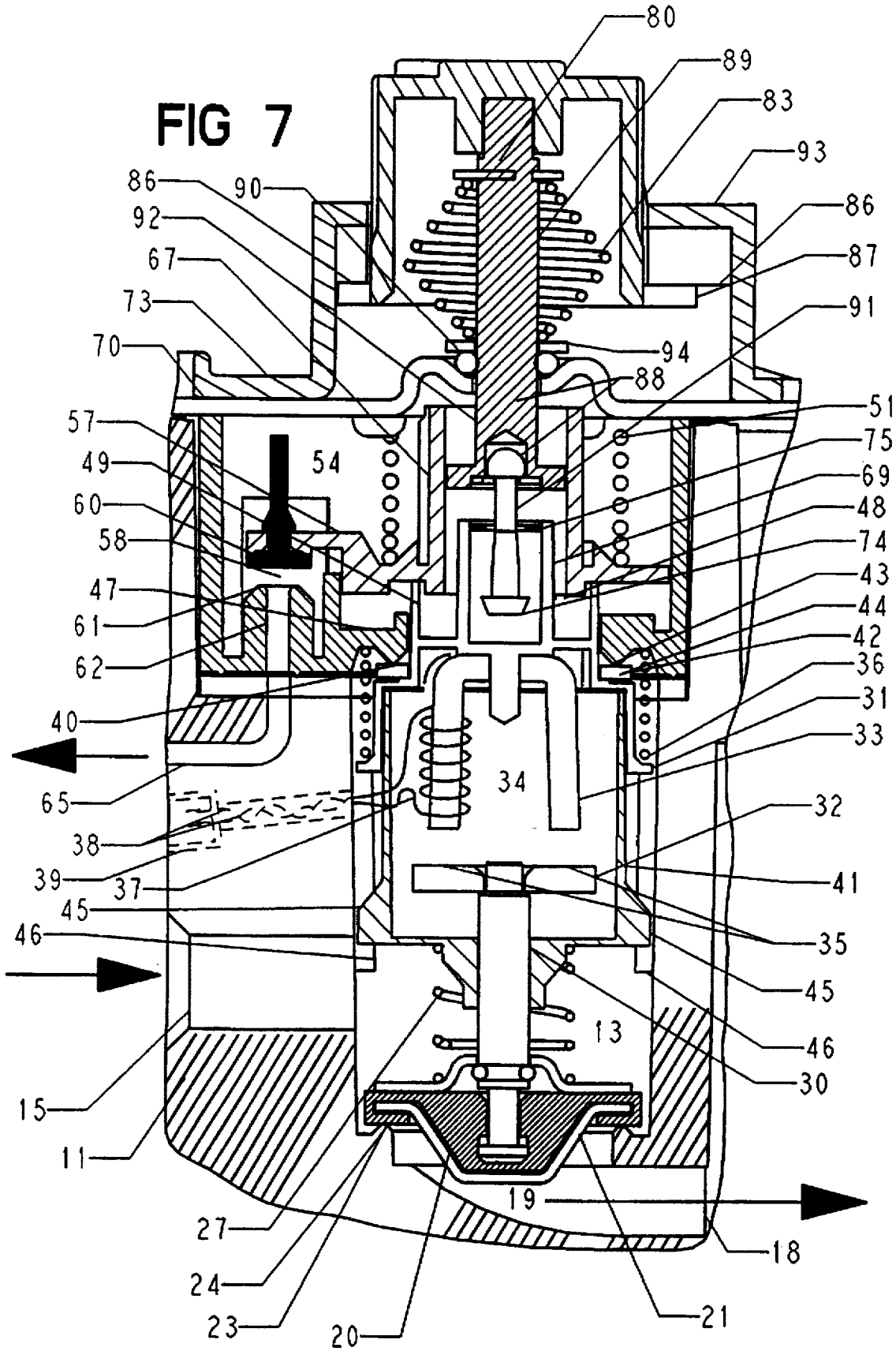
FIG. 7 shows the functional configuration of the various elements of the burner controller in a final stage off position, where the enable signal is absent.

FIGS. 6 and 7 show the burner controller 10 with its knob 80 in the OFF position. It is possible for knob 80 to be rotated into the OFF position either while an enable signal is present (FIG. 6) or while the enable signal is not present (FIG. 7). To explain the operation of burner controller 10 while in the functional configuration of FIG. 6, it is necessary to further describe features of an interlock element 55 within auxiliary chamber 54. Flange 92 has a radially extended feature such as a spline which mates with an internal feature of a projection 67 on valve body 55 and causes interlock element 55 to rotate with knob 80.

When interlock element 55 rotates with knob 80 into the OFF position, a third or auxiliary pilot safety valve 58 carried on interlock element 55 provides a further control of fuel flow to pilot outlet port 65. Auxiliary pilot safety valve 58 is in series flow arrangement with main pilot safety valve 40 and positioned in this embodiment in the fuel ducting or flow stream between the auxiliary chamber 54 and pilot outlet port 65. Auxiliary pilot safety valve 58 is designed to close in the situation where the knob 80 is turned to its OFF position and the enable signal holds valve bodies 20 and 41 in their reduced spacing configuration. This is necessary to prevent fuel flow to pilot outlet port 65 while these conditions exist. As previously mentioned, there is a lag between the time a pilot flame goes out and the enable signal provided by the flame sensor. During this time, fuel may flow to both the main and pilot outlet ports 18 and 65. This fuel flow is undesirable, particularly at a time when the operator may attempt to relight the pilot burner.

Auxiliary pilot safety valve 58 has an auxiliary pilot valve body 57 forming a part of interlock element 55 and carrying its own auxiliary pilot seal 60. Auxiliary pilot seal 60 is designed to mate with an auxiliary pilot valve seat 61 encircling the end of duct 62 opening into chamber 54, and when so mated, to prevent fuel flow from chamber 54 to pilot outlet port 65. When knob 80 is rotated into either the PILOT or ON positions, valve body 57 is rotated away from the position adjacent the end of duct 62 and shown in FIGS. 6 and 7. In the open position for auxiliary pilot valve 58 shown in FIG. 7, main pilot safety valve 40 is closed so that fuel cannot flow to pilot outlet port 65. When knob 80 is in the OFF position, auxiliary pilot valve body 57 can move along a third or auxiliary pilot valve path between the open position shown in FIG. 7 and the closed position shown in FIG. 6 where the seal 60 is mated with the auxiliary pilot valve seat 61. When pilot valve body 41 is in the closed position, no fuel flow from inlet port 15 and main chamber 13 to pilot outlet port 65 can occur even if the main pilot safety valve 40 is open.

The functional configuration shown in FIG. 6 arises if the enable signal is present (typically because the flame sensor has not yet cooled sufficiently) when knob 80 is turned to the OFF position. There is at least one slot or other depression 47 in the bottom of chamber 54 facing interlock element 55. Interlock element 55 has a ridge or other projection 48 facing the bottom of chamber 54 and designed to mate with slot 47 when interlock element 55 rotates with knob 80 into the OFF position. When interlock element 55 is rotated with knob 80 into the OFF position, compression spring 51 presses interlock element 55 toward the bottom of chamber 54, causing ridge 48 to mate with slot 47. This has two effects. First, auxiliary valve body 57 moves to its closed position. Secondly, the interference between projection 48 and slot 47 prevents knob 80 from rotating out of its OFF position.

After a period of time, the enable signal will vanish and armature 32 will separate from pole ends 35 with the aid of compression spring 27. The extension force range of spring 27 is designed to exceed the combined forces of springs 36 and 51. Spring 27 can thus force valve body 41 toward interlock element 55 to cause an annular face 49 of pilot valve body 41 to press against the adjacent surface of interlock element 55. This force lifts interlock element 55 so that ridge 48 disengages from slot 47. Pilot valve body 41 then moves to its closed position as shown in FIG. 7, with auxiliary valve body 57 now in its open position. This relationship now allows interlock element 55 to rotate freely and knob 80 to be no longer restrained from rotating into its PILOT position in which the pilot flame may be relit (FIG. 5). In this way, relighting of the pilot flame is delayed until the flame sensor no longer provides the enable signal.

The preceding description allows one of skill in the art to practice our invention, which is defined by the following claims:

1. A fluid flow control device for controlling flow of fluid from an inlet port of a housing to first and second outlet ports of the housing according to the state of an electrical enable signal, said device comprising:

a) a housing with a main chamber internal thereto and having i) the inlet port in flow communication with the main chamber, ii) a first outlet opening in the main chamber in flow communication with said first outlet port, iii) a first valve seat encircling the first outlet opening, iv) a second outlet opening in flow communication with said second outlet port, and v) a second valve seat encircling said second outlet opening;

b) a first valve body for mating with the first valve seat, said first valve body movable along a first valve path between an open position with the first valve body spaced from the first valve seat and which allows fluid flow between the main chamber and the first outlet port, and a closed position in which the first valve body mates with the first valve seat to block fluid flow between the main chamber and the first outlet port;

c) a second valve body for mating with the second valve seat, said second valve body movable along a second valve path between an open position with the second valve body spaced from the second valve seat and which allows fluid flow between the main chamber and the second outlet port, and a closed position in which the second valve body mates with the second valve seat to block fluid flow between the main chamber and the second outlet port, said first and second valve bodies having a reduced spacing relationship in which each of the valve bodies can be spaced from its respective valve seat;

d) a first compression spring disposed between and operatively engaging the first and second valve bodies, said compression spring providing restoring force simultaneously urging each valve body into its closed position with a preselected first spring extension force range; and e) an electromechanical latch assembly in mechanical connection with the first and second valve bodies, said latch receiving the enable signal and responsive thereto providing a valve holding force larger than the preselected first spring extension force, said latch for holding the first and second valve bodies in the reduced spacing relationship.

2. The device of claim 1, further comprising a valve positioner connected mechanically between one of the valve bodies and the housing, said positioner movable from an on position to a pilot position, said positioner's on position holding both the first and second valve bodies in their open position, and said positioner's pilot position holding the first valve body in its closed position and the second valve body in its open position.

3. The device of claim 2, wherein the first valve body includes a second spring bearing surface facing the second valve seat and the housing further includes a second spring bearing surface in facing relation to the first spring bearing surface, and a second compression spring between the first and second spring bearing surface, said second compression spring having an extension force range substantially less than the first compression spring's extension force range; and wherein the valve positioner further comprises a position limiter element in mechanical connection with the second valve body, said position limiter element in its on position and when the latch is holding the valve bodies in their reduced spacing relationship, applying force to the second valve body opposing the second compression spring's extension force, and positioning both the first and second valve bodies in their open positions.

4. The device of claim 3, wherein the valve positioner includes a knob mechanically connected to the housing, said knob manually adjustable between an on position holding the position limiter element in its on position, and a pilot position displaced from the on position, said valve positioner when in said pilot position removing the position limiter element force from the second valve body, said second compression spring responsive thereto applying force to the second valve body, and while the first and second valve bodies are in their reduced spacing relationship, displacing the first and second valve bodies to a position placing the first valve body in its closed position.

5. The device of claim 4 wherein the valve positioner further comprises a cam and follower in mechanical contact with each other and forming an interface between the housing and the knob, said cam and follower controlling the position of the knob as a function of the knob's manual adjustment, said cam and follower cooperating with the knob when in its pilot position to allow the position limiter element to reach its pilot position.

6. The device of claim 2, wherein the latch has hold and release positions, said hold position retaining the valve bodies in their reduced spacing relationship responsive to the enable signal, said release position entered under the extension force of the first compression spring when the enable signal is absent, and wherein the valve positioner includes a restart feature pressing on the second valve body when the valve positioner is in a restart position and compressing the first compression spring, said restart position of the valve positioner holding the latch in its hold position independent of the enable signal.

7. The device of claim 2, further including a) a portion of the housing defining an auxiliary chamber internal to the housing and in flow communication through a third outlet opening with the second outlet port and with the main chamber through the second outlet opening, said auxiliary chamber having a third valve seat encircling the third outlet opening;

b) a third valve body having an open position spaced from the valve seat and a closed position mated with the third valve seat and preventing fluid flow therethrough;

c) a knob carried on the housing and movable from an on to an off position; and c) an interlock linkage mechanically connected to the third valve body, to the knob, and to the latch assembly, said interlock linkage holding the third valve body in its closed position responsive to the off position of the knob and the latch assembly holding the first and second valve bodies in their reduced spacing relationship.

8. The device of claim 7, wherein the interlock linkage further comprises a feature on the housing and a mating feature on the third valve body, said housing and third valve body features mating when the knob is moved to its off position and cooperating to prevent further movement of the knob while the first and second valve bodies are in their reduced spacing relationship.

9. The device of claim 8, wherein the knob is mounted for rotation on a shaft between its on and off position, said shaft connected to shift the third valve body from adjacent to the third valve seat with the knob in the off position, to a position nonadjacent to the third valve seat, and a third spring pressing the third valve body toward the third valve seat.

10. A fluid flow control device for conditioning flow of fluid from a supply pipe to first and second outlet ports on presence of an electrical enable signal, and interrupting flow of fluid from the supply pipe to the first and second outlet ports on absence of the enable signal, a) a housing having an interior chamber, said housing having an inlet port for connection to the supply pipe;

b) a first valve seat surrounding a first opening of the interior chamber to said first outlet port;

c) a second valve seat surrounding a second opening of the interior chamber to said second outlet port, said second valve seat facing the first valve seat and spaced therefrom;

d) a first valve body for mating with the first valve seat, said first valve body movable along a first valve path between an open position spaced from the first valve seat and which allows fluid flow between the interior chamber and the first outlet port, and a closed position in which the first valve body mates with the first valve seat to block fluid flow between the interior chamber and the first outlet port;

e) a second valve body for mating with the second valve seat, said second valve body movable along a second valve path between an open position spaced from the second valve seat and which allows fluid flow between the interior chamber and the second outlet port, and a closed position in which the second valve body mates with the second valve seat to block fluid flow between the interior chamber and the second outlet port;

f) a linkages disposed between and operatively engaging the first and second valve bodies, said linkage including a first spring applying simultaneously to the first and second valve bodies, force urging each valve body along its respective valve path into its closed position with a preselected first spring extension force; and g) an electromechanical latch in mechanical connection with the first and second valve bodies, said latch receiving the enable signal and responsive thereto providing a valve holding force larger than the preselected first spring extension force, said latch opposing the force applied to the first and second valve bodies by the first spring and holding the first and second valve bodies in their open positions.

11. The device of claim 10, further comprising a second spring in mechanical connection to at least one of the first valve and the linkage, said second spring applying force to the linkage urging the first valve body into its closed position.

12. The device of claim 11, further comprising a valve positioner mechanically connected to at least one of the valve bodies, said valve positioner having an on position and a pilot position, and holding both valve bodies in their open position when in its on position, and releasing the first valve body to enter its closed position under the second spring's force when in its pilot position.

13. The device of claim 12, further including an auxiliary valve assembly interposed to control fluid flow from the second valve between the second valve opening and the second valve outlet port, said auxiliary valve assembly in mechanical connection with the valve positioner and the latch, wherein the valve positioner has a further off position, said auxiliary valve assembly entering a closed position in which no fluid can pass through the auxiliary valve assembly responsive to the latch holding the first and second valve bodies in their reduced spacing relationship, and to the valve positioner in its off position, and entering an open position otherwise.

14. The device of claim 13, further including an interlock mechanism in mechanical connection to the latch, wherein, when said valve positioner is in its off position and the valve bodies are in their reduced spacing relationship, said interlock mechanism holds said valve positioner in the off position.

* * * * *